US009219321B2

(12) United States Patent
Chen et al.

(10) Patent No.: US 9,219,321 B2
(45) Date of Patent: Dec. 22, 2015

(54) ANTI-DEFORMATION LOW PROFILE CARD EDGE CONNECTOR

(71) Applicants: BELLWETHER ELECTRONIC CORP., Taoyuan County (TW); BELLWETHER ELECTRONIC (KUNSHAN) CORP., Kunshan (CN)

(72) Inventors: Kuan-Wu Chen, Taoyuan County (TW); Hsing-Yu Lee, Taoyuan County (TW)

(73) Assignees: BELLWETHER ELECTRONIC CORP., Taoyuan County (TW); BELLWETHER ELECTRONIC (KUNSHAN) CORP., Kunshan, JS (CN)

( * ) Notice: Subject to any disclaimer, the term of this patent is extended or adjusted under 35 U.S.C. 154(b) by 0 days.

(21) Appl. No.: 14/505,665

(22) Filed: Oct. 3, 2014

(65) Prior Publication Data

US 2015/0162682 A1 Jun. 11, 2015

(30) Foreign Application Priority Data

Dec. 9, 2013 (TW) ..... 102223075 U

(51) Int. Cl.
*H01R 24/00* (2011.01)
*H01R 12/72* (2011.01)

(52) U.S. Cl.
CPC ..... *H01R 12/721* (2013.01)

(58) Field of Classification Search
CPC ..... H01R 12/721; H01R 12/716; H01R 12/87
USPC ..... 439/630, 59, 62, 260, 267, 325, 629, 439/159
See application file for complete search history.

(56) References Cited

U.S. PATENT DOCUMENTS

| | | | | |
|---|---|---|---|---|
| 6,527,568 | B2 * | 3/2003 | Nakamura | H05K 5/0295 439/159 |
| 7,052,295 | B1 * | 5/2006 | Lin | H01R 31/06 439/159 |
| 7,241,177 | B1 * | 7/2007 | Lai | H01R 13/2442 439/635 |
| 7,410,376 | B2 * | 8/2008 | Ying | H01R 13/2442 439/159 |
| 7,517,237 | B2 * | 4/2009 | Ting | G06K 13/08 235/441 |

* cited by examiner

*Primary Examiner* — Vanessa Girardi
(74) *Attorney, Agent, or Firm* — Chun-Ming Shih; HDLS IPR Services

(57) ABSTRACT

An anti-deformation low profile card edge connector includes an insulation body having a transverse elongated shape and a plurality of terminals. The insulation body has a top portion and a bottom portion forming along a transverse direction of the insulation body. An insertion slot is indentedly formed between the top portion and the bottom portion. The bottom portion is connected to a terminal base protruding further out than the top portion. Each terminal is respectively arranged on the terminal base to insert into the insertion slot. The insulation body and the terminal base are connected in such a manner that a space is reserved between them, and thereby the even contact between each terminal and the circuit board is not affected by deformation during a process of welding the card edge connector and a circuit board together.

10 Claims, 6 Drawing Sheets

ANTI-DEFORMATION LOW PROFILE CARD EDGE CONNECTOR

BACKGROUND

1. Technical Field

The present invention relates to an electrical connector, and in particular, to an anti-deformation low profile card edge connector.

2. Related Art

In light of the characteristics required by modern 3C products, such as lightness, thinness, shortness, and compactness, a module card for insertion into a notebook and etc. has been developing toward low-profile designs. Therefore, a card edge connector for use in a memory card module and etc. is inevitably developing toward compact designs.

However, to realize the low-profile designs by reducing the thickness of an insulation base of the card edge connector, because an insulation body has insufficient strength and may deform under heat during a process of welding the card edge connector to the circuit board by using a tin melting furnace and etc., there occurs a problem in maintaining an even contact between each terminal in the insulation body and the circuit board. The problem is particularly difficult for the front row terminals of the card edge connector, on which load application or other methods are unable to apply, and thus it is difficult to solve the aforesaid problem.

In view of the foregoing, the inventor made various studies to improve the above-mentioned problems to realize the improvements, on the basis of which the present invention is accomplished.

BRIEF SUMMARY

It is an object of the present invention to provide an anti-deformation low profile card edge connector, wherein an insulation body of the card edge connector and the terminal base are separately disposed and then connected in such a manner that a space is reserved between them, so that even though the thin thickness of the insulation body may cause deformation and other problems during a process of welding the card edge connector to the circuit board by passing through a tin melting furnace, the deformation of the insulation body is unlikely to affect the evenness quality between the terminal base and the circuit board, thereby solving the aforesaid problem.

Accordingly, the present invention provides an anti-deformation low profile card edge connector which includes an insulation body in a transverse elongated shape and a plurality of terminals. The insulation body has a top portion and a bottom portion forming along a transverse direction of the insulation body. An insertion slot is indentedly formed between the top portion and the bottom portion. The bottom portion is connected to a terminal base protruding further out than the top portion. Each of the terminals is respectively arranged on the terminal base to insert into the insertion slot. The insulation body and the terminal base are connected in such a manner that a space is reserved between them.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

In the following, detailed descriptions along with accompanied drawings are given to better explain the features and technical contents of the present invention. However, the following descriptions and the accompanied drawings are for reference and illustration only, and are not intended to limit the scope of the present invention.

Figure 1:
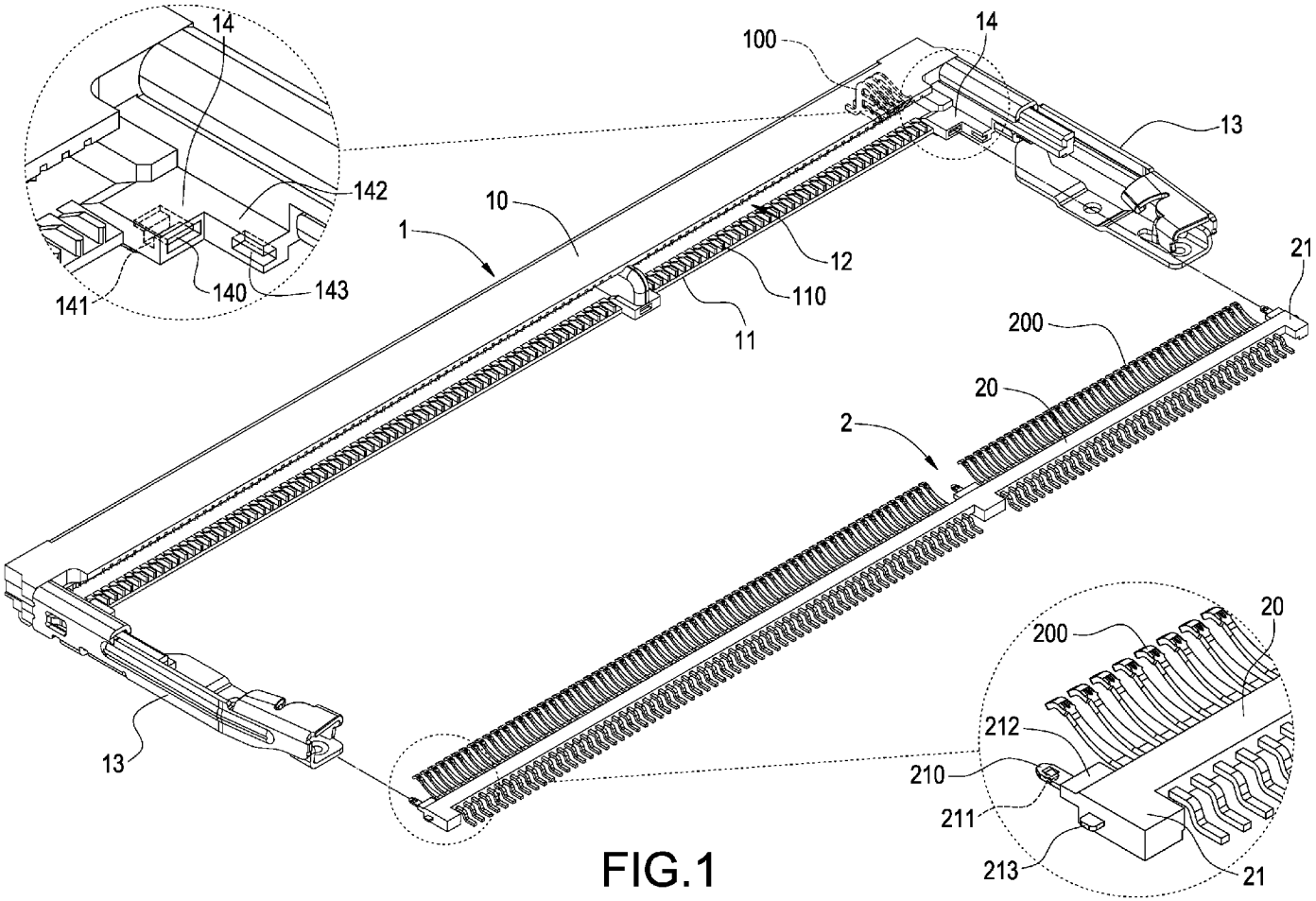
FIG. 1 is a schematic perspective exploded view of the present invention.
Figure 2:
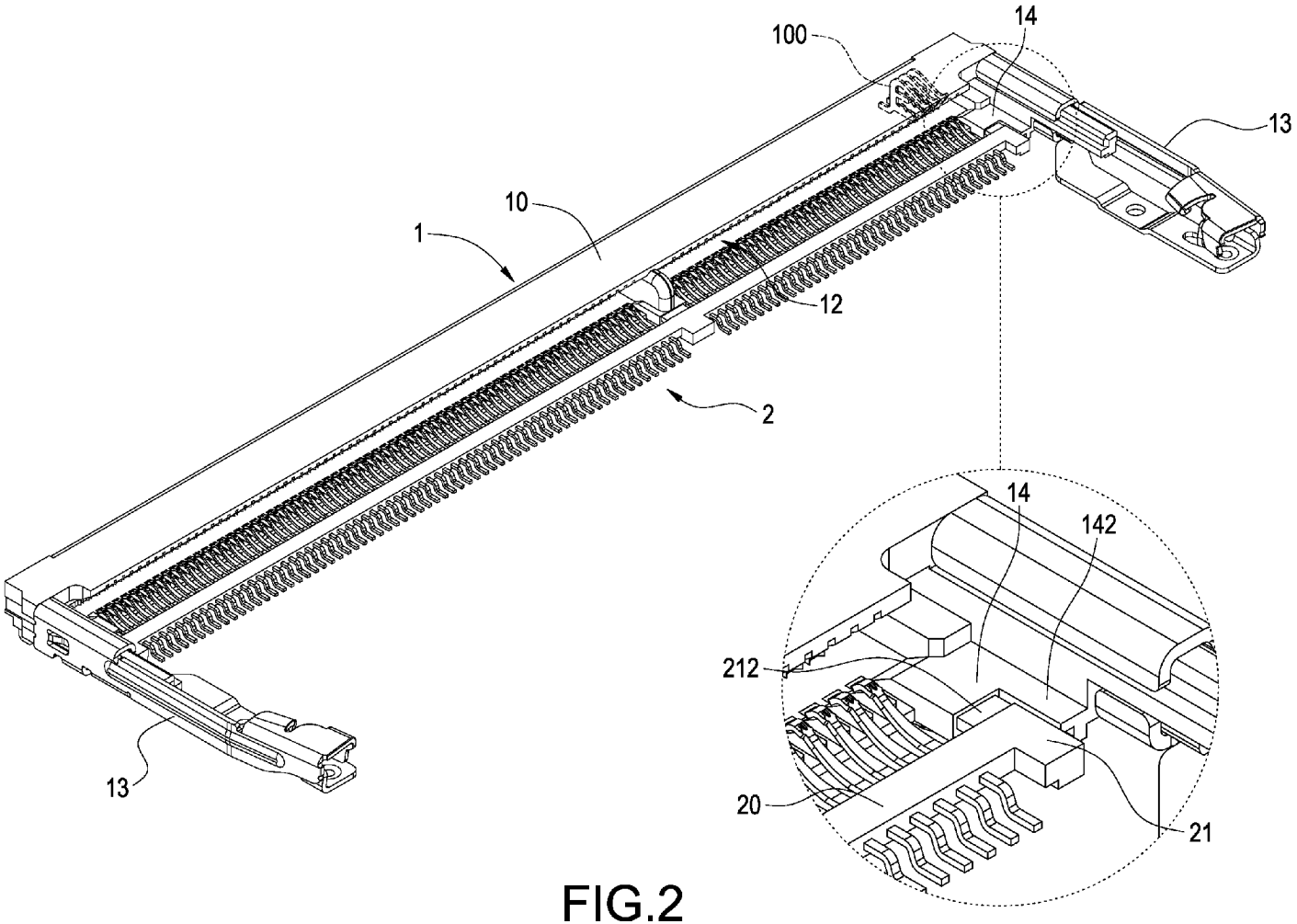
FIG. 2 is a schematic perspective assembled view of the present invention.
Figure 3:
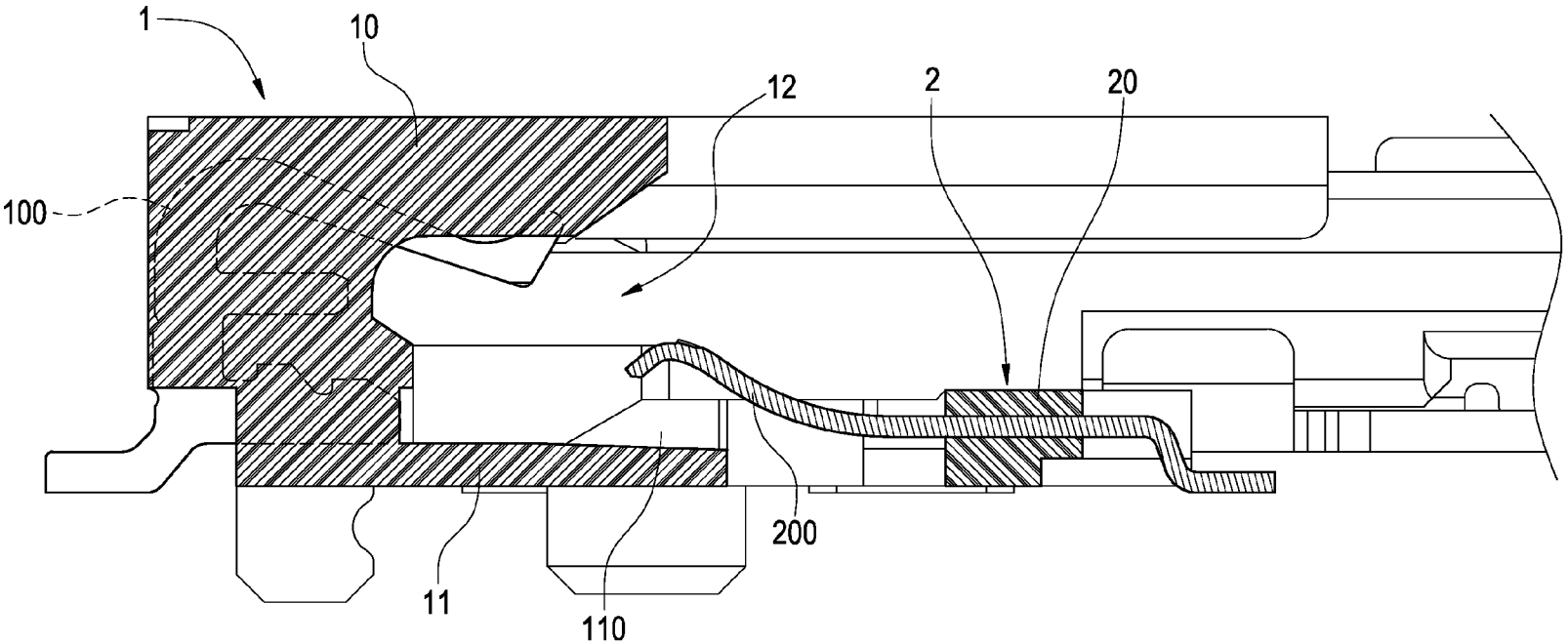
FIG. 3 is a schematic cross-sectional view of the present invention.

Please refer to FIGS. 1 and 2 which are a schematic perspective exploded view and a schematic perspective assembled view of the present invention, respectively. The present invention provides an anti-deformation low profile card edge connector for being welded and electrically connected to a circuit board (not illustrated), and also for insertion of a module card such as a Double Data Rate Synchronous Dynamic Random Access Memory (DDR SDRAM, not illustrated). The card edge connector includes an insulation body 1 and a plurality of terminals 2 disposed in the insulation body 1. The insulation body 1 consists of an insulation material and is in a transverse elongated shape. The thickness of the insulation body 1 can be below 4 mm, and the insulation body 1 has a top portion 10 and a bottom portion 11 forming along a transverse direction of the insulation body 1. The thickness of the insulation body 1 is a distance from an upper edge of the top portion 10 to a lower edge of the bottom portion 11 of the insulation body 1 (as shown in FIG. 3). An insertion slot 12 is indentedly formed between the top portion 10 and the bottom portion 11 for a module card (not illustrated) such as the DDR SDRAM to insert into the insulation body 1. A side arm 13 extending forward respectively forms at two sides of the top portion 10 and the bottom portion 11. Along an extending direction of the two side arms 13, the bottom portion 11 is connected to a terminal base 20 protruding further out than the top portion 10.

Moreover, the terminal base 20 also consists of the insulation material, and each terminal 2 is respectively arranged on the terminal base 20 for insertion into the insertion slot 12, and thereby the inserted module card can be electrically connected to each terminal 2. In order to prevent a contacting portion 200 of each terminal 2 from contacting an adjacent one, baffles 110 are disposed outside and close to the insertion hole 12 and are arranged in a laterally spaced apart manner, such that the contacting portion 200 of each terminal 2 can extend into between any two adjacent baffles 110. Furthermore, as shown in FIG. 3, another row of upper row terminals 100 can be arranged in the top portion 10 of the insulation body 1 and is also for being electrically connected to the inserted module card; however, the details of which belong to conventional techniques and are not within the scope of the present invention, so are omitted herein.

The insulation body 1 and the terminal base 20 are separately disposed, and then are connected in such a manner that a space is reserved between them. By this way, even though the thin thickness of the insulation body 1 may cause deformation and other problems during a process of welding the card edge connector to the circuit board by passing through a tin melting furnace, the deformation of the insulation body 1 is unlikely to affect the evenness quality and other effects between the terminal base 20 and the circuit board. Please also refer to FIG. 4 and FIG. 5. A coupling portion 14 is disposed on the bottom portion 11 of the insulation body 1. The coupling portion 14 may be in a plural number as required to couple the insulation body 1 and the terminal base 20 together, and a location of the coupling portion 14 can change according to design requirements, for example at two ends in the transverse direction of the bottom portion 11 or at a middle section of the bottom portion 11. The coupling portion 14 includes a coupling hole 140 indented toward the terminal base 20, a coupling block 21 is correspondingly disposed on the terminal base 20, an inserting piece 210 extending toward the coupling hole 140 is disposed on the coupling block 21, and the inserting piece 210 inserts into the coupling hole 140. As shown in FIG. 5, the above-mentioned "being connected in such a way that a space is reserved" is detailed as follows. When connecting the insulation body 1 to the terminal base 20, a lateral gap D forms between the coupling hole 140 and the inserting piece 210. Since deformation of the insulation body 1 is usually laterally formed in an arch-shape, by laterally reserving the lateral gap D between the coupling hole 140 and the inserting piece 210, the deformation of the insulation body 1 is unlikely to affect the terminal base 20, and the terminal base 20 maintains its original evenness to be welded to the circuit board.

Referring also to FIG. 1, FIG. 2, and FIG. 5, in order that the coupling hole 140 and the inserting piece 210 may be coupled more stably, an engagement slot 141 is disposed in the coupling hole 140, and the inserting piece 210 includes an engagement block 211 corresponding to the engagement slot 141, so the inserting piece 210 can insert into the coupling hole 140 to make the engagement block 211 engaged in the engagement slot 141, thereby enhancing the coupling strength between the insulation body 1 and the terminal base 20. Furthermore, the coupling block 21 further includes an extending section 212 extending toward the coupling portion 14, and the inserting piece 210 extends from a front edge of the extending section 212 toward the coupling hole 140.

Figure 4:
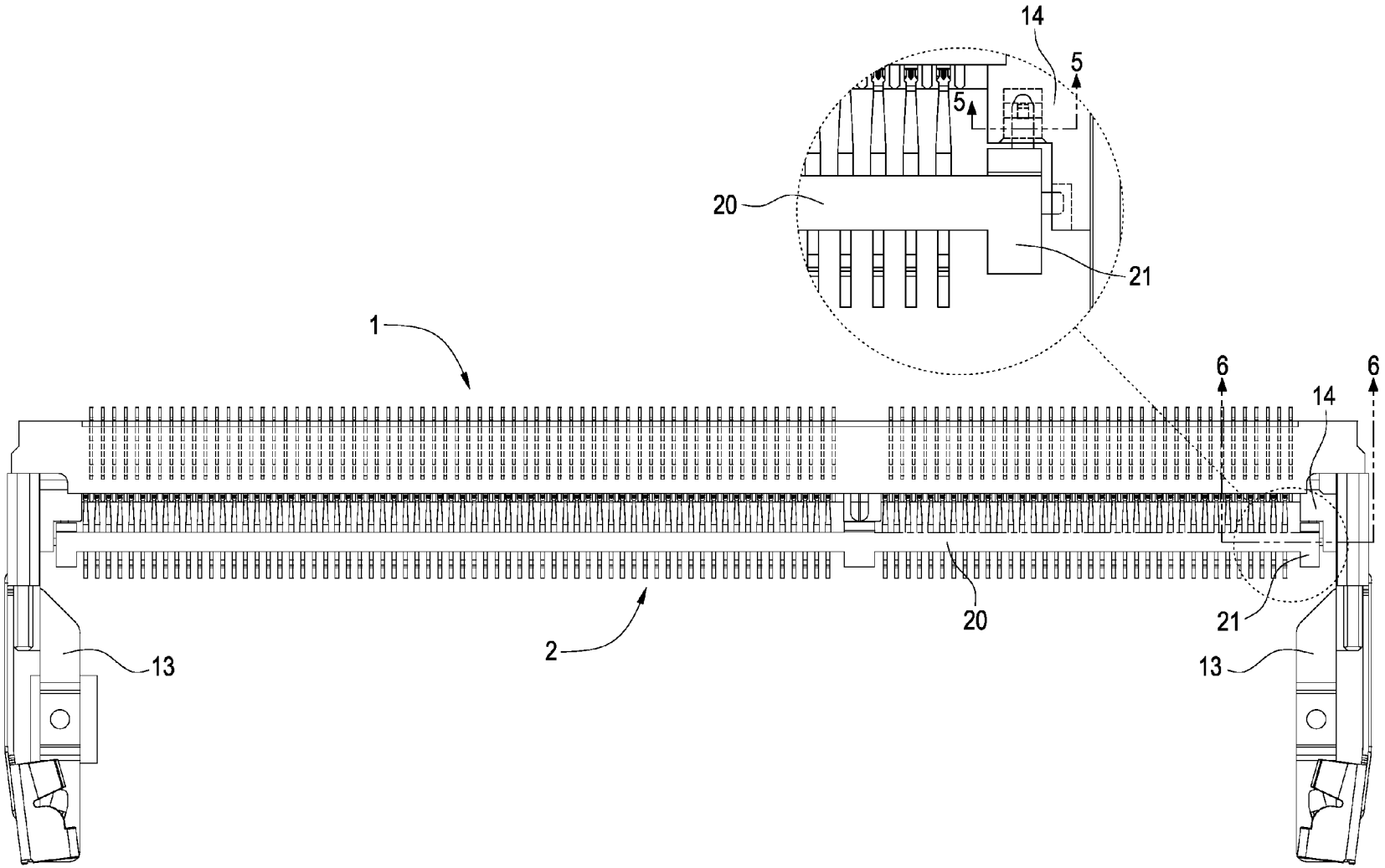
FIG. 4 is a schematic top view of the present invention.
Figure 5:
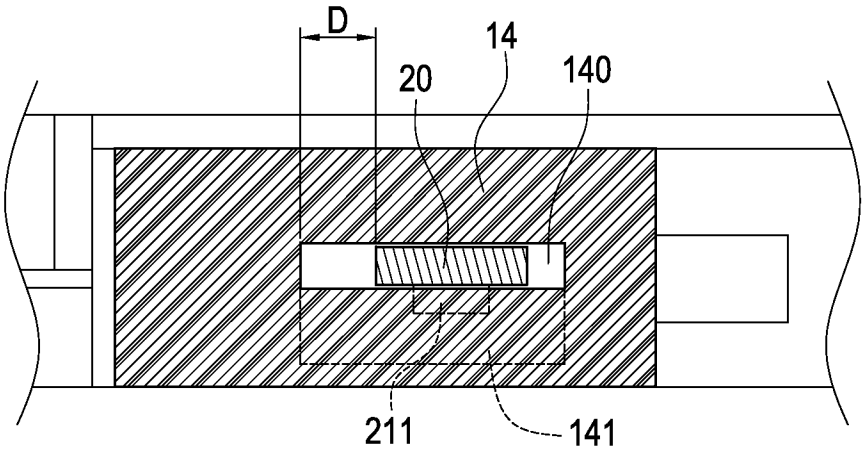
FIG. 5 is a cross-sectional view taken along line 5-5 in an enlarged section of FIG. 4.
Figure 6:
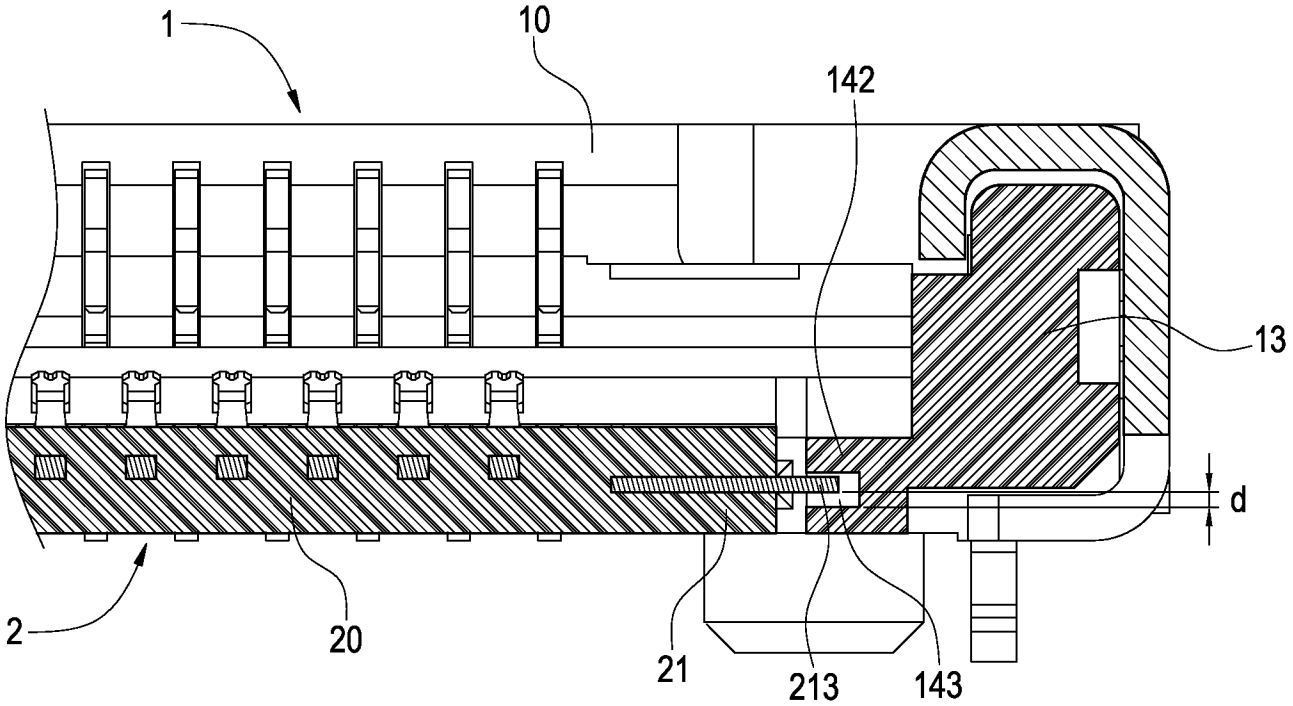
FIG. 6 is a cross-sectional view taken along line 6-6 of FIG. 4.

Moreover, referring to FIG. 1, FIG. 4, and FIG. 6, for alignment consideration when coupling the terminal base 20 to the insulation body 1, the coupling portion 14 is preferably disposed at the two ends of the bottom portion 11 along its transverse direction, a sliding rail portion 142 extending toward the terminal base 20 is disposed at an outer side of each coupling portion 14, a sliding groove 143 is indentedly disposed at an inner side of the sliding rail portion 142, a sliding piece 213 corresponding to the sliding groove 143 is disposed at an outer side of the coupling block 21, and the sliding piece 213 inserts into the sliding groove 143. Moreover, the sliding piece 213 and the sliding groove 143 are coupled in the same manner as mentioned above, that is reserving a space between them, and a height gap d is upperly or lowerly reserved between the sliding piece 213 and the sliding groove 143, so that the sliding rail portion 142 and the coupling block 21 are correspondingly aligned in a limited space, and even though they might deform during their coupling, there is no mutual influence between them. Accordingly, the above-mentioned structures constitute the anti-deformation low profile card edge connector of the present invention.

In summary, the present invention is a unique utility patent product, can certainly achieve the anticipated objects and improve the defects of conventional techniques, and has novelty and non-obviousness, so the present invention completely meets the requirements of a utility patent. Therefore, a request to patent the present invention is filed according to patent laws. Examination is kindly requested, and allowance of the present invention is solicited to protect the rights of the inventor.

It is to be understood that the above descriptions are merely preferable embodiment of the present invention and not intended to limit the scope of the present invention. Equivalent changes and modifications made in the spirit of the present invention are regarded as falling within the scope of the present invention.

What is claimed is:

1. An anti-deformation low-profile card edge connector, comprising:

an insulation body, the insulation body having a transverse elongated shape, a top portion and a bottom portion forming along a transverse direction of the insulation body, and an insertion slot indentedly formed between the top portion and the bottom portion, the bottom portion being connected to a terminal base protruding further out than the top portion; and a plurality of terminals respectively arranged on the terminal base to insert into the insertion slot, wherein the insulation body and the terminal base are connected in such a manner that a space is reserved between the insulation body and the terminal base.

2. The anti-deformation low-profile card edge connector of claim 1, wherein a side arm is respectively formed at two sides of the top portion and the bottom portion.

3. The anti-deformation low-profile card edge connector of claim 1, wherein a coupling portion is disposed on the bottom portion, the coupling portion includes a coupling hole indented toward the terminal base, a coupling block is correspondingly disposed on the terminal base, an inserting piece extending toward the coupling hole is disposed on the coupling block, and the inserting piece inserts into the coupling hole.

4. The anti-deformation low-profile card edge connector of claim 3, wherein a lateral gap is between the coupling hole and the inserting piece.

5. The anti-deformation low-profile card edge connector of claim 4, wherein the coupling block further includes an extending section extending toward the coupling portion, and the inserting piece extends from a front edge of the extending section toward the coupling hole.

6. The anti-deformation low-profile card edge connector of claim 4, wherein an engagement slot is disposed in the coupling hole, and the inserting piece includes an engagement block corresponding to the engagement slot, and the inserting piece inserts into the coupling hole to make the engagement block engaged in the engagement slot.

7. The anti-deformation low-profile card edge connector of claim 4, wherein the coupling portion is located on a middle section of the bottom portion along the transverse direction thereof.

8. The anti-deformation low-profile card edge connector of claim 3, wherein at least one coupling portion is additionally disposed so as to be in a plural number.

9. The anti-deformation low-profile card edge connector of claim 8, wherein each of the coupling portions is disposed at two ends of the bottom portion along the transverse direction thereof.

10. The anti-deformation low-profile card edge connector of claim 9, wherein a sliding rail portion extending toward the terminal base is disposed at an outer side of each of the coupling portions, a sliding groove is indentedly disposed at an inner side of the sliding rail portion, a sliding piece corresponding to the sliding groove is disposed at an outer side of the coupling block, and the sliding piece inserts into the sliding groove to form a height gap between the sliding piece and the sliding groove.

* * * * *